US005283955A

United States Patent [19]

Liang

[11] Patent Number: 5,283,955

[45] Date of Patent: Feb. 8, 1994

[54] CONTACT AND INDUCTION CUTTING MACHINE

[76] Inventor: Cheng K. Liang, 6, Alley 10, Lane 118, Syh Wei Rd, Wou Ku Shiang, Taipei, Taiwan

[21] Appl. No.: 59,379

[22] Filed: May 11, 1993

[51] Int. Cl.[5] ..... B26B 7/00

[52] U.S. Cl. ..... 30/275; 83/DIG. 1

[58] Field of Search ..... 30/273, 274, 275; 83/DIG. 1, 936; 173/170

[56] References Cited

U.S. PATENT DOCUMENTS 4,325,186 4/1982 Creton ..... 83/DIG. 1
4,698,910 10/1987 Gundlach ..... 83/DIG. 1
4,712,303 12/1987 Barrett ..... 30/275
4,803,781 2/1989 Jung et al. ..... 30/275
5,134,259 7/1992 Page, Jr. ..... 83/DIG. 1

*Primary Examiner*—Scott Smith
*Attorney, Agent, or Firm*—Bacon & Thomas

[57] ABSTRACT

The present invention relates to a cutting machine the blade of which is controlled to slide up and down for cutting a stack of cloth by means of an induction produced through the contact of an inductive handle of the machine with an operator's hand. The sensitive contact and induction control manner permits an operator to easily, safely and efficiently start, stop, and resume the sliding movement of the blade without the need to repeatedly switch on or off the cutting machine.

2 Claims, 4 Drawing Sheets

CONTACT AND INDUCTION CUTTING MACHINE

BACKGROUND OF THE INVENTION

The present invention relates to a contact and induction cutting machine, and more particularly to a cutting machine in which a sensitive and reliable induction control circuit is used to control the movement of the cutting machine so that the cutting machine may be operated in a safer, simpler, more convenient, and more efficient manner.

To cut the material for making clothes in an efficient manner, most of the ready-made clothes manufacturers now use cutting machines to cut stacked material so as to reduce as many as possible the operating procedures. The cutting machine employed to cut the stacked material usually has an thin, elongate and belt-like blade supported by a blade holder. The blade is up-and-down slidable in the blade holder when it is actuated by a motor above the blade holder. To stop the movement of the blade while the cutting machine is in use, it is necessary to power off the machine. For a floor operator, there are many different kinds of condition that would need an operator to discontinue the movement of the blade. The repeated operation to start, discontinue, and again start the machine is bothersome and inefficient. To save as many as possible efforts during the operation of the cutting machine, some of the operators might even boldly perform other tasks, for example, replace a new stack of material, without switching off the machine, and therefore, the operators are easily hurt by an unexpectedly slided blade. Therefore, it is desirable to have improved and safer design for such cutting machine which is widely employed by ready-made clothes manufacturers so as to prevent as many as possible accidents during the operation.

SUMMARY OF THE INVENTION

A primary object of the present invention is to provide a cutting machine in which an inductive handle is provided in addition to a conventional manual power switch, whereby, the cutting machine, when its manual power switch is on, can be controlled to work or not to work via the inductive handle, that is, when an operator grips the inductive handle, the blade of the cutting machine shall be actuated to slide up and down, and on the other hand, when the operator releases the inductive handle, a sensitive induction controlling means on the machine shall immediately cause the power circuit becoming an open circuit and thereby discontinue the movement of the blade. When the operator grips the handle again, the induction controlling means shall immediately close the power circuit to resume the movement of the blade for cutting material.

BRIEF DESCRIPTION OF THE DRAWINGS

The above and other objects of the present invention as well as the technical means adopted to achieve these objects can be best understood through the following detailed description of the preferred embodiments and the accompanying drawings wherein.

DETAILED DESCRIPTION OF THE PREFERRED EMBODIMENTS

Figure 1:
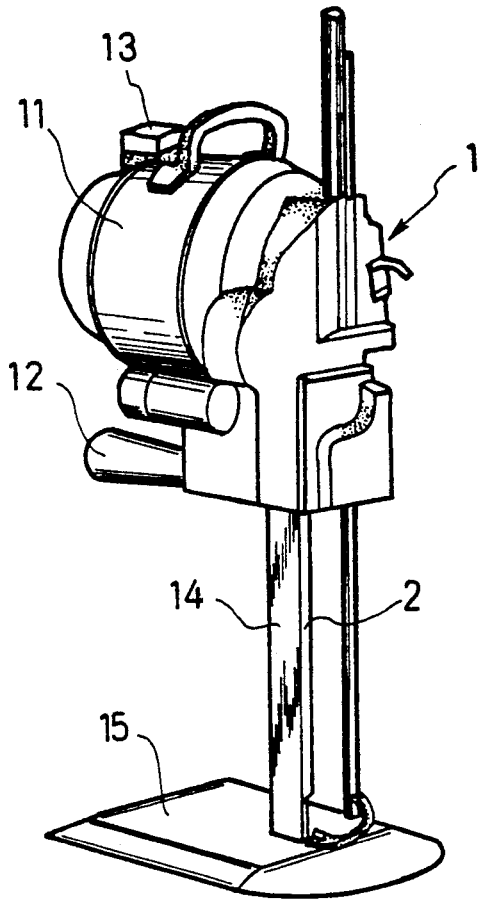
FIG. 1 (PRIOR ART)
FIG. 1 is a three-dimensional perspective of a conventional cutting machine employed by the ready-made clothes manufacturers.
Figure 2:
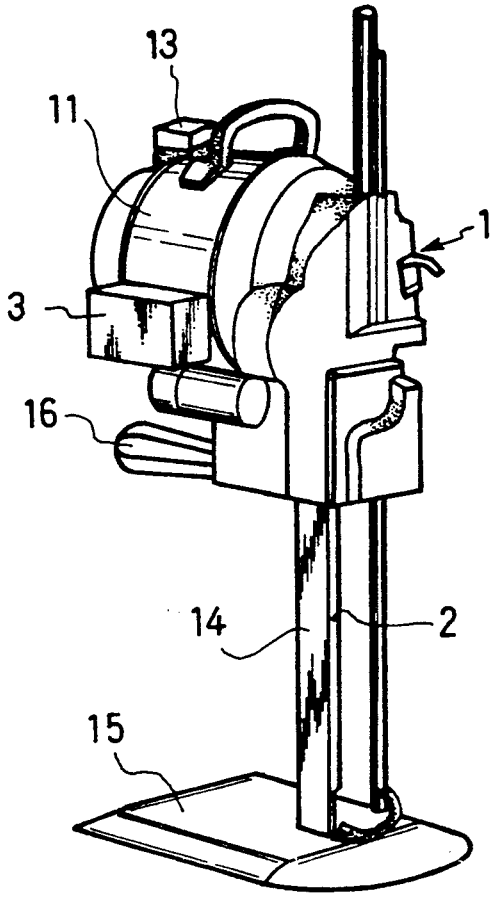
FIG. 2 is a three-dimensional perspective of a cloth cutting machine according to the present invention.

Please refer to FIG. 2. A contact and induction cutting machine 1 according to the present invention comprises a motor 11 for supplying power required by the cutting machine 1, a flat base 15, an elongate belt-like blade 2 for cutting, a blade holder 14 for connecting and supporting the motor 1 over the flat base 2, an inductive handle 16, and an induction controlling means 3.

The motor 11 drives the blade 2 to slide up and down in reciprocating action at high speed within the blade holder 14. The blade holder 14 serves as a guide rail of the slide stroke of the blade 2. In addition, the blade holder 14 supports the motor 11 and connects the same with the flat base 15 to form an integrally structured cutting machine 1.

Figure 3:
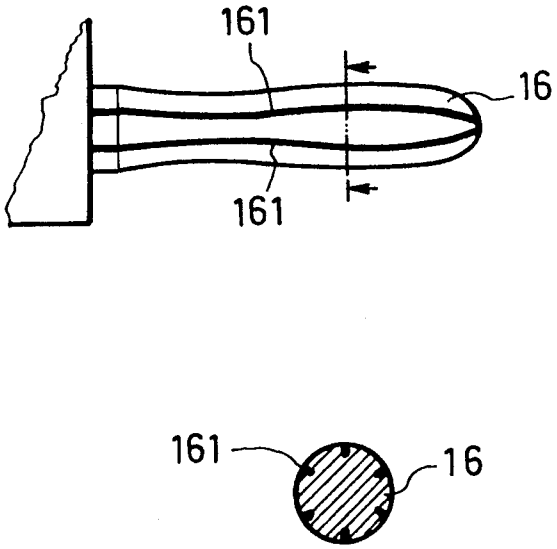
FIG. 3 shows the inductive handle adopted in the present invention and the cross section thereof showing its structure.
Figure 4:
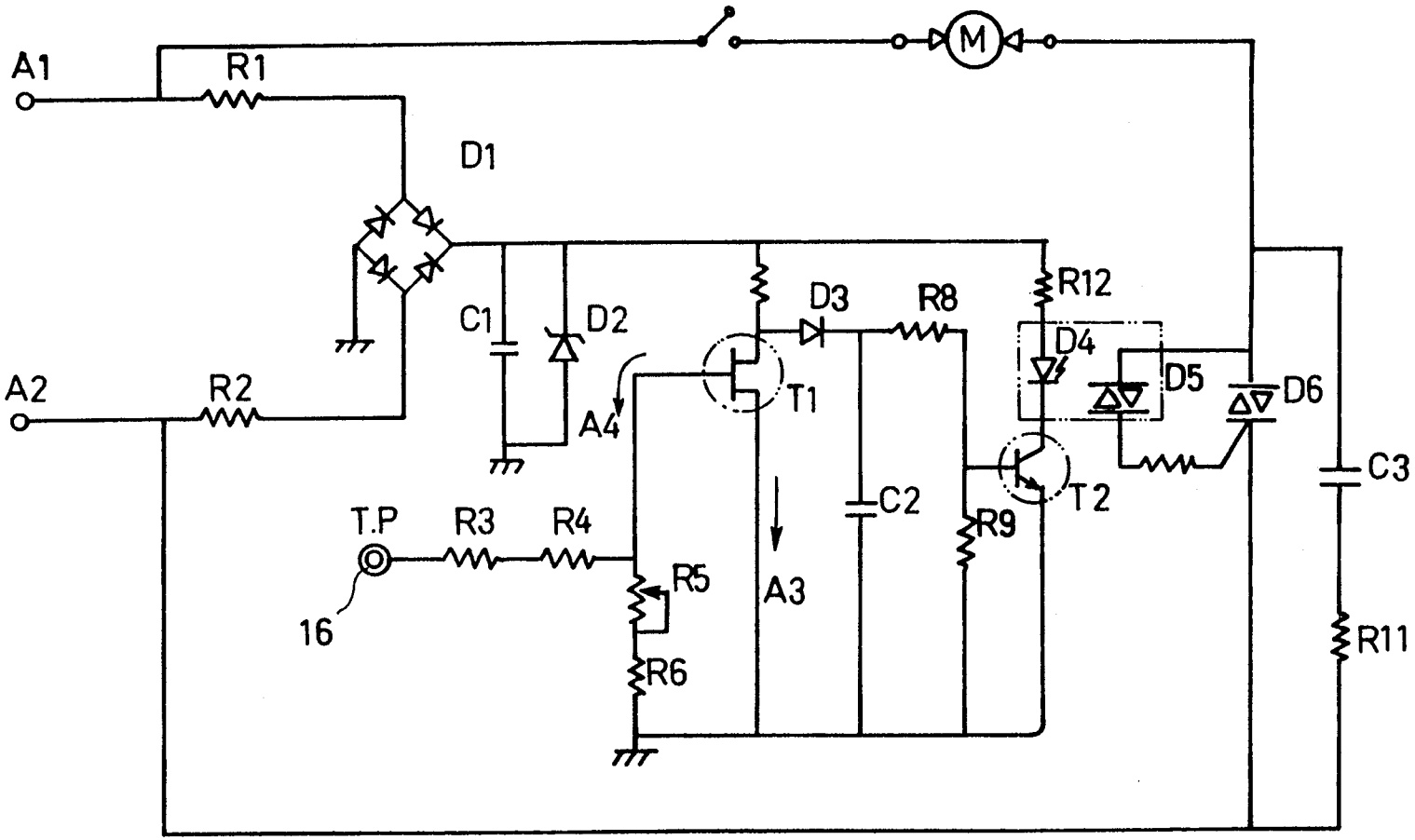
FIG. 4 is the induction control circuit diagram of the present invention.

Please now refer to FIG. 3. The inductive handle 16 used to control and guide the movement of the cutting machine 1 has a plurality of high-conductibility inductive copper sheets 161 inset around the periphery of its grip portion. When an operator grips the handle 16, an electrostatic induction is produced which causes the induction controlling means 3 below the motor 11 to become a close circuit which enables the motor 11 to run. Reversely, when the operator releases the handle 16, the electrostatic induction disappears, the induction controlling means 3 becomes an open circuit, and the motor 11 stops running. FIG. 4 is a control circuit diagram for an induction control circuit system of the induction controlling means 3. A current passes A1, A2 and flows through a bridge rectifier D1 and then a resistor R7 and finally flows into a field effect transistor (FET) T1. Before the field effect transistor T1, there is a voltage stabilizing protection loop comprising a capacitor C1 and a Diode D2. One end of the field effect transistor T1 is connected to the inductive copper sheets 161 of the inductive handle 16 while two resistors R4, R3 are provided between the field effect transistor T1 and the inductive copper sheets 161. When the cutting machine 1 is powered by turning on a manual power switch thereof but the inductive handle 16 thereof has not been gripped by an operator, the current shall flow to a loop A3 instead of passing a diode D3 and a resistor R8 and flowing into a transistor T2, and therefore, the transsistor T2 can not work to get a diode D4 to emit light. Accordingly, a diode AC-switch (DIAC) D5 in the circuit fails to receive any signal to make a triode AC-switch (TRIAC) D6 and the entire induction control circuit can not become a close circuit to enable the motor 11 to run. However, when the operator wants to use the cutting machine 1 to cut a stack of cloth and grips the handle 16, the contact of the operator's hand with the handle 16 will immediately cause a current to pass the resistor R7 and flows into the field effect transistor (FET) T1. At this point, the contact of the operator's hand with the inductive copper sheets 161 produces an electrostatic induction, and the field effect transistor T1 allows the current to pass the diode D3 and the resistor R8, and finally flows into the transistor T2. At this point, the transistor T2 works and the circuit becomes a close circuit which permits the diode D4 to emit light as a signal. This signal is received by the diode AC-switch (DIAC) D5 which in turn allows the current to flow through a resistor R10 and into the triode AC-switch (TRIAC) D6 which allows the current to flow toward the motor 11 and actuates the same.

Since the existence of the electrostatic induction depends on the contact of an operator's hand with the inductive handle 16 of the cutting machine 1, and the combination of light and electricity is employed in the control circuit, the cutting machine 1 can be operated in a safer and more reliable manner while the condition of interference can be eliminated.

Figure 5:
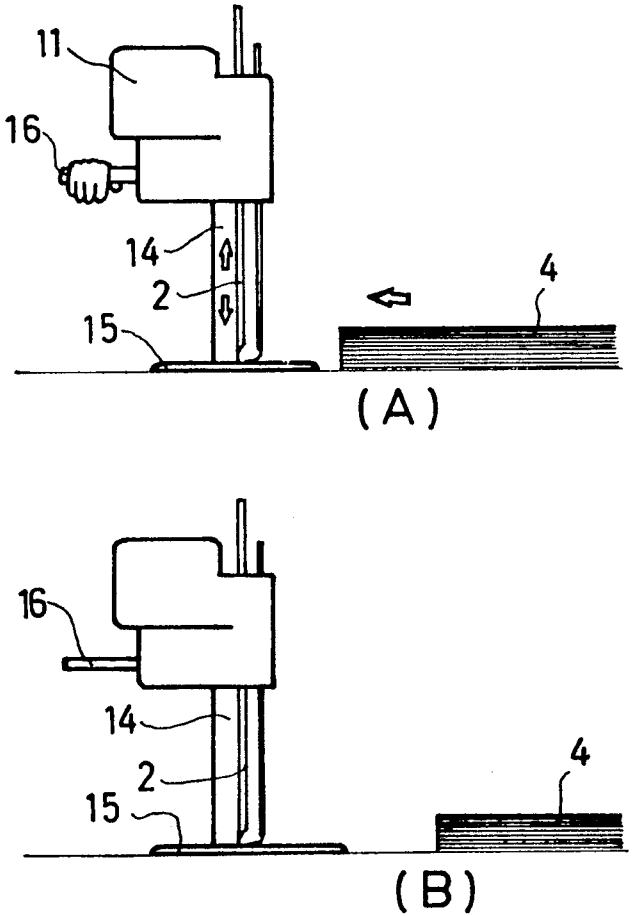
FIGS. 5A and 5B illustrate the operation of the present invention.

The motor 11 of the cutting machine 1 according to the present invention can run and drives the blade 2 to slide in reciprocating action for cutting only when the manual switch of the machine 1 is turned on and the inductive handle 16 is gripped by an operator, as shown in FIG. 5A. In the event the operator wants to do some other works during the operation and temporarily discontinue the cutting, he or she needs only to release the inductive handle 16 without turning off the manual power switch. As soon as the inductive handle 16 is released, the induction controlling means 3 connecting with the handle 16 shall immediately send a signal to stop the motor 11. The motor will resume its running only when the inductive handle 16 is gripped by the operator again. Since the cutting machine 1 may be conveniently and effectively controlled to run or not run simply by the contact of the operator's hand with the inductive handle, accident and injury unexpectedly caused by the sliding blade 2 during the operation may be minimized.

The foregoing description exemplifies preferred embodiment of the present invention. Still other variations and rearrangements of component parts are possible without departing from the spirit and scope of this invention and will readily present themselves to one skilled in the art.

What is claimed is:

1. A contact and induction cutting machine comprising a motor, a blade holder, a base, an inductive handle, and an induction controlling means;

said motor being located at a left upper corner of said cutting machine and being controlled by said induction controlling means to drive an elongate belt-like blade to slide up and down in reciprocating action at high speed within said blade holder;

said blade holder being located between said motor and said base and being a substantially flat column having a slide rail therein for said blade to slide therein in reciprocating action, said blade holder also acting as a support of said motor to connect said motor with said base;

said base being an extremely thin body for supporting said entire cutting machine;

said inductive handle being located below said induction controlling means and having a plurality of high-conductibility inductive copper sheets inset at adequate interval around the periphery of said inductive handle, said inductive handle, when being gripped by an operator, being capable of producing an electrostatic induction; and said induction controlling means being located at one side of said motor and above said inductive handle and being controlled via an induction control circuit; at the time said inductive handle being contacted by a conductor, for example, an operator's hand, and thereby producing an electrostatic induction, a field effect transistor T1 in said induction control circuit causing a current to pass a diode D3 and a resistor R8 and flow into a transistor T2 which in turn causes a diode D4 to emit light as a signal which is received by a diode AC-switch (DIAC) D5 to cause a current to pass a resistor R10 and flow into a triode AC-switch (TRIAC) D6, and thereby making the entire induction control circuit a close circuit; at the time said induction control circuit becoming a close circuit, said motor being powered and actuated to drive said blade to slide up and down in reciprocating action for cutting a stack of cloth; reversely, said induction control circuit becoming an open circuit and said motor stopping runing at the time said inductive handle being released, or being separated from a conductor and said electrostatic induction disappeared and thereby said signal of emitted light discontinued.

2. A contact and induction cutting machine as claimed in claim 1, wherein said induction control circuit of said induction controlling means becomes an open circuit to disable said motor from running while said cutting machine is manually switched on but said inductive handle thereof is not gripped by an operator, because there is not electrostatic induction produced by said inductive handle in a released state and therefore, said field effect transistor T1 fails to cause a current to flow toward said transistor T2 and said diode D4 fails to be made nor can it emit light as a signal to said diode AC-switch D5 for the same to cause a current to flow into said triode AC-switch D6; and wherein said induction control circuit becomes a close circuit to enable said motor to run when said cutting machine is manually switched on and said inductive handle is gripped by an operator, because there is an electrostatic induction produced by said inductive handle in a gripped state and therefore, said field effect transistor T1 causes a current to pass said diode D3 and said resistor R8 to flow into said transistor T2 which in turn causes said diode D4 to emit light as a signal for said diode AC-switch D5 to cause a current to pass said resistor R10 and flow into and make said triode AC-switch D6.

* * * * *